US007079028B2

(12) United States Patent
Herrmann et al.

(10) Patent No.: US 7,079,028 B2
(45) Date of Patent: Jul. 18, 2006

(54) MODULAR INTRUSION DETECTION SYSTEM

(75) Inventors: Falk Herrmann, Fairport, NY (US); Robert E. Walters, Webster, NY (US); Patrick Vervaele, Aartrijke (BE); Bart Skold, Rancho Murieta, CA (US); Gabor Kocsis, München (DE)

(73) Assignee: Robert Bosch GmbH, Stuttgart (DE)

( * ) Notice: Subject to any disclaimer, the term of this patent is extended or adjusted under 35 U.S.C. 154(b) by 154 days.

(21) Appl. No.: 10/797,969

(22) Filed: Mar. 11, 2004

(65) Prior Publication Data

US 2005/0200494 A1 Sep. 15, 2005

(51) Int. Cl.
*G08B 13/00* (2006.01)

(52) U.S. Cl. ..... 340/541; 340/546; 340/545.6; 340/692; 340/572.9

(58) Field of Classification Search ..... 340/541, 340/546, 545.6, 565, 571, 552, 555, 568.1, 340/567, 572.1, 572.8, 692, 572.9, 539.11
See application file for complete search history.

(56) References Cited

U.S. PATENT DOCUMENTS

| | | | | |
|---|---|---|---|---|
| 4,266,216 | A * | 5/1981 | Trusty | 340/546 |
| 4,347,590 | A | 8/1982 | Heger et al. | 367/93 |
| 4,540,977 | A * | 9/1985 | Taillens et al. | 340/552 |
| 4,864,136 | A | 9/1989 | Behlke | 250/338.3 |
| 5,077,548 | A | 12/1991 | DiPoala et al. | 340/522 |
| 5,382,944 | A | 1/1995 | DiPoala et al. | 340/567 |
| 5,398,057 | A | 3/1995 | Tapp | 348/154 |
| 5,424,718 | A * | 6/1995 | Muller et al. | 340/567 |
| 5,448,320 | A | 9/1995 | Sakai et al. | 354/81 |
| 5,450,062 | A | 9/1995 | DiPoala | 340/552 |
| 5,473,368 | A | 12/1995 | Hart | 348/155 |
| 5,657,076 | A | 8/1997 | Tapp | 348/154 |
| 5,980,123 | A | 11/1999 | Heifler | 396/427 |
| 6,049,273 | A * | 4/2000 | Hess | 340/539.11 |
| 6,285,912 | B1 * | 9/2001 | Ellison et al. | 700/1 |

FOREIGN PATENT DOCUMENTS

| | | |
|---|---|---|
| EP | 1189066 A | 3/2002 |
| WO | WO 95/34988 | 12/1995 |

* cited by examiner

*Primary Examiner*—Thomas Mullen
*Assistant Examiner*—Daniel Previl
(74) *Attorney, Agent, or Firm*—Baker & Daniels LLP

(57) ABSTRACT

A modular intrusion detection system that includes a base unit having a primary intrusion detection device and a housing. The primary housing includes a base housing section and an outer cover. The base housing section includes a first mounting interface. A plurality of different secondary housing sections having a second mounting interface which can be attached to the first mounting interface of the base housing section are provided. The secondary housing sections may have a functional device, such as a CCD camera or a microphone, associated therewith. The camera or microphone may be activated to an alarm signal generated by the intrusion detection device. A plurality of different base units, each having an intrusion detection device, may also be provided wherein each of the base units is attachable to each of the secondary housings, and secondary devices associated therewith, to provide flexibility in assembling individual devices.

25 Claims, 12 Drawing Sheets

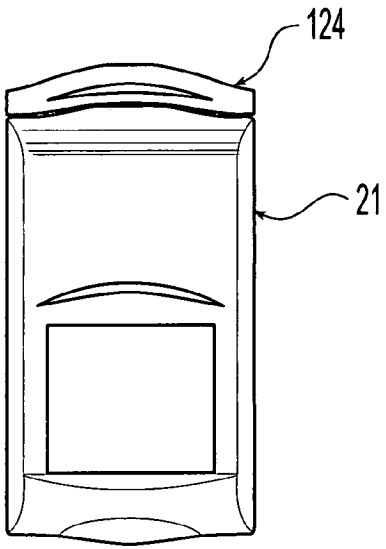
Fig. 13
Fig. 12
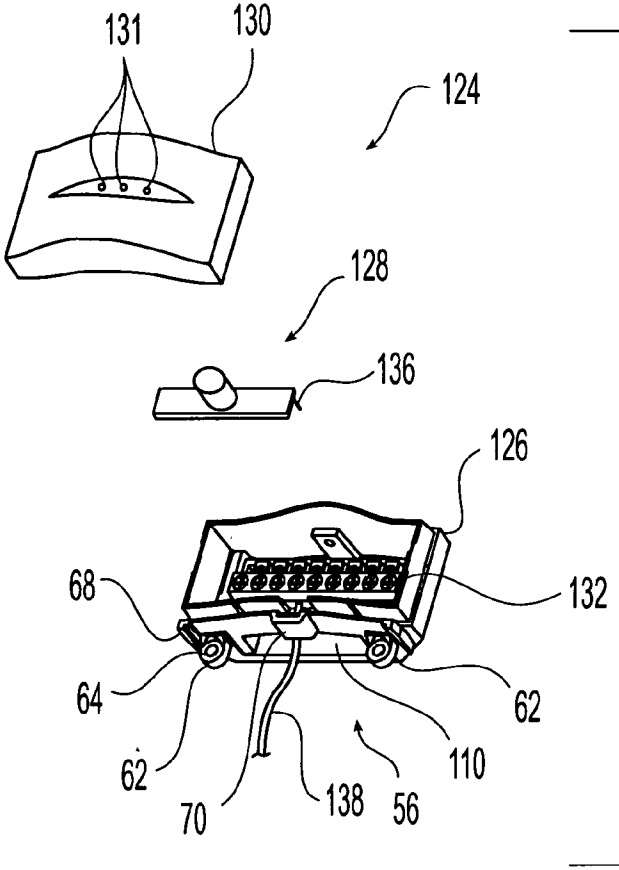

MODULAR INTRUSION DETECTION SYSTEM

BACKGROUND OF THE INVENTION

1. Field of the Invention

The present invention relates to intrusion detection systems and, more particularly, an intrusion detection system that can be combined with other functional features such as a camera or microphone.

2. Description of the Related Art

Intrusion detection systems are well known in the art. Such systems may rely on passive infrared (PIR) sensors, microwave radar transceivers or other form of device to detect the presence of an intruder in the monitored space. Such systems typically generate an alarm signal that is transmitted to a remote, central location which may be manned by security personnel. Such systems may also generate an audible alarm if desired.

It is also known to combine intrusion detection systems with other functional devices such as a camera or microphone. In such systems, it is common for the intrusion detection device to trigger the operation of the other device, such as the camera or microphone, upon the detection of an intruder in the monitored space. The images or sounds captured by the camera or microphone may then be transmitted to the central location where they can be reviewed by security personnel and/or recorded. Such combinations are typically provided in a housing that is specifically manufactured to house a combination of a specific intrusion detection device and a specific camera or microphone.

A drawback to systems including both an intrusion detection system and another functional device is that users will want to have the ability to install intrusion detection devices that do not include the additional functional devices as well as intrusion detection devices that do include the additional function device.

Manufacturers of intrusion detection systems typically manufacture a variety of such devices, e.g., PIR sensor-based devices, microwave transceiver-based devices and combination devices utilizing both PIR sensors and microwave transceivers. If the manufacturer desires to offer additional functions with such detectors, the number of different models that the manufacturer must make and inventory can become excessive. For example, if the manufacturer has four types of detectors and three different types of additional function features, e.g., a color camera, a black and white camera and a microphone, that can be added to the detectors, the manufacturer would have to make sixteen different models to provide the user with option of a basic detector, a detector with color camera, a detector with black and white camera, and a detector with microphone, for each of the different types of detectors. Oftentimes, a manufacturer will choose to limit the number of options provided to the user in such a situation to reduce the number of different models and simplify inventory control.

SUMMARY OF THE INVENTION

The present invention provides a modular intrusion detection system that allows a base unit having an intrusion detection device to be used by itself or be combined with any one of a number of different functional modules such as a camera module or a microphone module.

The invention comprises, in one form thereof, a modular intrusion detection system that includes a base unit having a primary device disposed within a primary housing wherein the primary device is an intrusion detection device and the primary housing defines a first mounting interface. The system also includes a plurality of secondary housing sections wherein each of the secondary housing sections has a second mounting interface. Each of the second mounting interfaces is engageably securable to the first mounting interface to thereby securably attach a selected one of the secondary housing sections to the primary housing. At least one of the secondary housing sections has a secondary device associated therewith.

In one embodiment, the primary housing includes a base housing section and a removable cover wherein the base housing section defines the first mounting interface. The removable cover includes a first attachment feature and each of the secondary housing sections includes a second attachment feature that is engageable with the first attachment feature. Attachment of the cover to the base housing section includes engaging the first attachment feature with the second attachment feature of the selected one of the secondary housing sections that has been securably attached to the primary housing section.

The secondary device may be an image capturing device, such as a charge coupled device (CCD), a microphone or other device that enhances the functionality of the intrusion detection system.

The invention comprises, in another form thereof, a modular intrusion detection system that includes a base unit having a primary device disposed within a primary housing. The primary device is an intrusion detection device which generates an alarm signal upon detection of an intruder. The modular system also includes a plurality of secondary devices each of which are selectively couplable to the primary device. At least one of the secondary devices is responsive to the alarm signal generated by the primary device when coupled to the primary device and each of the secondary devices is associated with a respective secondary housing section. The secondary housing sections are all directly attachable to the primary housing. A modular device is assembled by selecting one of the plurality of secondary devices, attaching the associated secondary housing section of the selected one of the secondary devices to the primary housing and coupling the selected one of the secondary devices to the primary device.

The invention comprises, in yet another form thereof, a modular intrusion detection system connectable to a security system. The modular system includes a base unit having a primary device disposed within a primary housing wherein the primary device is an intrusion detection device. The primary housing includes a primary terminal strip that is connectable to the security system and has a plurality of primary terminals. The primary device includes a plurality of primary conductive elements wherein each of the primary conductive elements are operably couplable with one of the plurality of primary terminals. A plurality of secondary devices are also included. Each of the secondary devices are operably couplable to the primary device and each of the secondary devices have a secondary housing section associated therewith. Each of the secondary housing sections are directly attachable to the primary housing section and have a secondary terminal strip. Each of the secondary terminal strips are connectable to the primary terminal strip and have a plurality of secondary terminals. Each of the secondary devices include a plurality of secondary conductive elements wherein each of the secondary conductive elements are operably couplable with one of the plurality of secondary terminals. A modular device is assembled by selecting one of the plurality of secondary devices, attaching the associated secondary housing section of the selected one of said secondary devices to the primary housing and coupling the selected one of the secondary devices to the primary device.

The invention comprises, in still another form thereof, a modular intrusion detection system including a plurality of base units. Each of the base units includes a primary device disposed within a primary housing. The primary devices are each one of a plurality of different intrusion detection devices and each of the primary housings defines a first mounting interface. A plurality of secondary housing sections is also provided. Each of the secondary housing sections have a second mounting interface wherein the second mounting interfaces are each engageable with each of the first mounting interfaces whereby each of the secondary housing sections are selectively attachable to each of the primary housings. At least one of the secondary housing sections has a secondary device associated therewith.

An advantage of the present invention is that it allows a greater number of different intrusion detection device configurations to be manufactured from a relatively small number of different component parts. Thereby simplifying inventory control and providing cost benefits.

Another advantage is that the present invention enables the intrusion detection device and the secondary devices to be upgraded on different schedules. For example, if the intrusion detection device is upgraded approximately every five years and the secondary device, e.g., a CCD camera, used with the intrusion detection device is upgraded every two years, the base unit which includes the intrusion detection device can remain unchanged when a CCD camera module attacheable to the base unit is upgraded.

BRIEF DESCRIPTION OF THE DRAWINGS

The above mentioned and other features and objects of this invention, and the manner of attaining them, will become more apparent and the invention itself will be better understood by reference to the following description of an embodiment of the invention taken in conjunction with the accompanying drawings, wherein:

FIG. 12 is an exploded view of a microphone module.

FIG. 13 is a view of the intrusion detection unit of FIG. 1 with the microphone module of FIG. 12 attached thereto.

Figure 1:
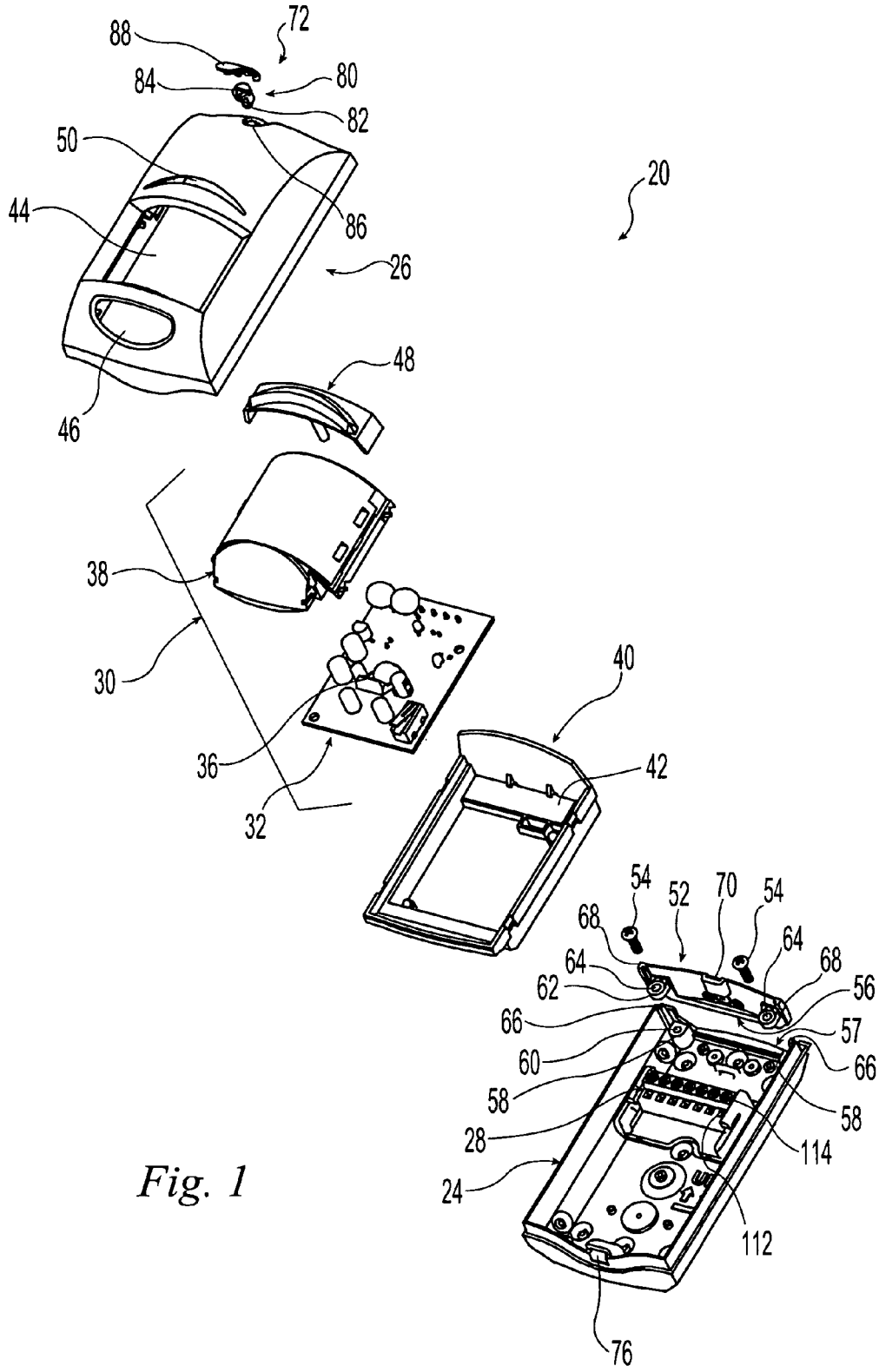
FIG. 1 is an exploded view of a first modular intrusion detection unit in accordance with the present invention.

Corresponding reference characters indicate corresponding parts throughout the several views. Although the exemplification set out herein illustrates the invention, the embodiments disclosed below are not intended to be exhaustive or to be construed as limiting the scope of the invention to the precise forms disclosed.

DESCRIPTION OF THE PRESENT INVENTION

In accordance with the present invention, a modular intrusion detection unit 20 is shown in FIG. 1. The illustrated unit includes a housing 22 that includes a base housing section 24 and a removable cover 26. The base housing section 24 includes a terminal strip 28. As discussed in greater detail below, terminal strip 28 includes a plurality of terminals and is connectable to a security system and to intrusion detection device 30. Intrusion detection device 30 includes a printed circuit board 32 having terminal pins 34 (FIG. 2) for engagement with terminal strip 28 and a passive infrared (PIR) sensor 36. Intrusion detection device 30 also includes a fresnel lens and holder 38 for focusing infrared light on PIR sensor 36. Intrusion detection devices utilizing PIR sensors and fresnel lens are well-known to those having ordinary skill in the art.

The printed circuit board (PCB) 32 is mounted between a protective cover 40 and outer cover 26. Flexible latches 41 on the inner surface of outer cover 26 secure cover 40 thereto. Cover 40 includes an opening 42 through which terminal pins 34 extend to engage terminal strip 28. Outer cover 26 also includes an upper window 44 and lower window 46 which are positioned over fresnel lens assembly 38 and through which infrared light enters lens assembly 38. A light pipe 48 is also mounted between outer cover 26 and PCB 32. Light pipe 48 is formed from a transparent polymeric material and has an elongate projection positioned adjacent a light emitting diode (LED) on PCB 32 and a curved projection positioned in slot 50 of outer cover 26. Light pipe 48 may thereby indicate the status of device 30 by transmitting light generated by an LED on PCB 32 to a location, i.e., slot 50, where it is visible from the exterior of the housing 22 as is well known in the art.

Figure 2:
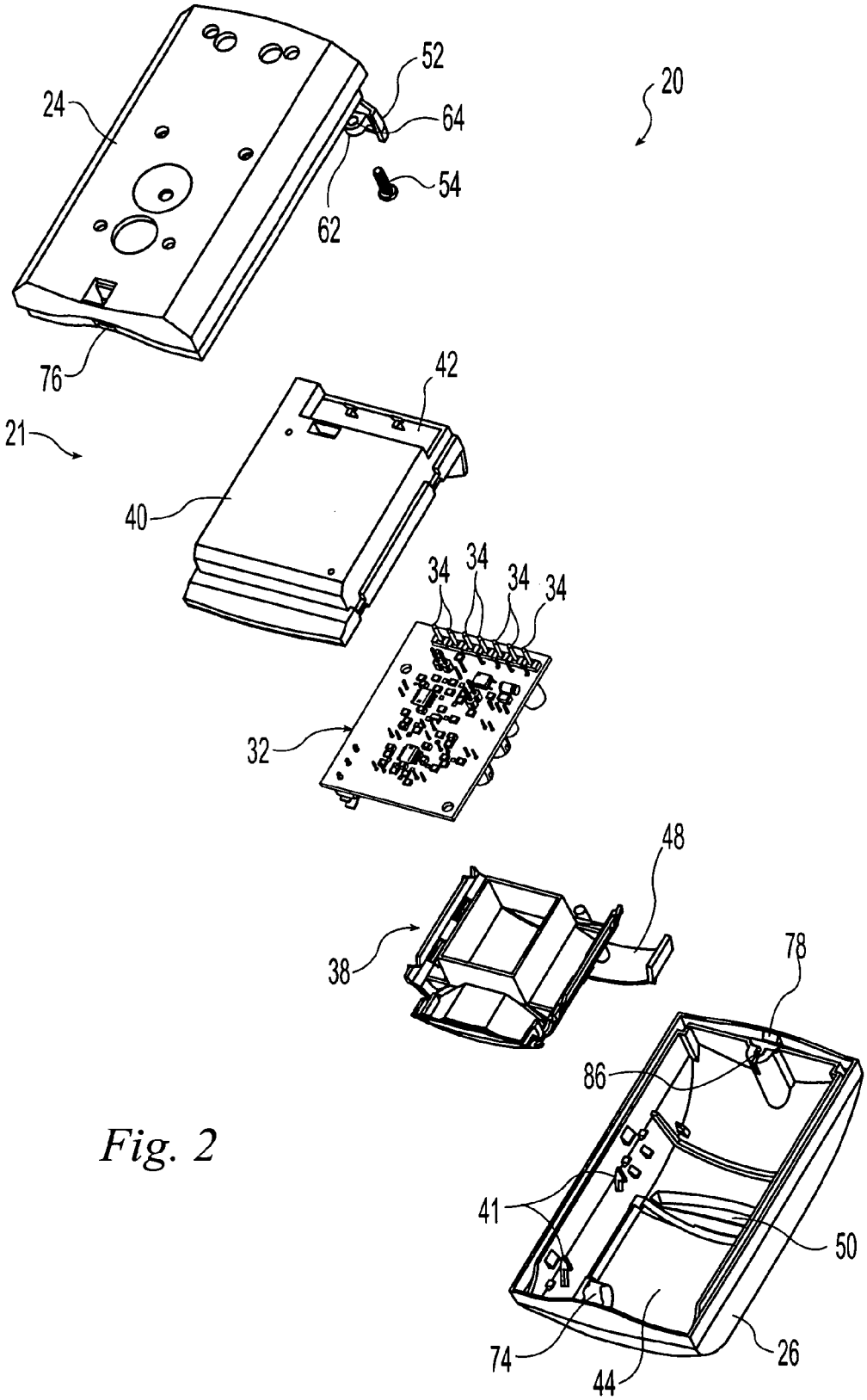
FIG. 2 is an other exploded view of the modular intrusion detection unit of FIG. 1.

The modular device 20 illustrated in FIGS. 1 and 2 also includes a secondary housing section 52. Secondary housing 52 is mounted directly to the primary housing 22 of modular device 20. In the illustrated embodiment, the secondary housing 52 is mounted to the base housing section 24. As best seen in FIG. 1, base housing section 24 defines a first mounting interface 57 that is engaged with a second mounting interface 56 on secondary housing section 52. The first mounting interface 57 defined by base housing section 24 includes two mounting posts 58 located at two corners of base housing section 24. Each mounting post 58 includes a threaded opening 60. The first mounting interface 57 also includes two corner recesses 66 located on the outer portion of the base housing section 24. The second mounting interface 56 includes projecting lugs 62 which define openings 64 and projecting ribs 68. When mounting the secondary housing section 52 to the base housing section 24, openings 64 are aligned with threaded openings 60, ribs 68 are snap fit into recesses 66 and then threaded fasteners are passed through openings 64 and threaded into engagement with openings 60 to thereby securely fasten secondary housing section 52 to base housing 24. In the embodiment shown in FIGS. 1 and 2, the lower edge 72 of secondary housing section 52 mates with base housing edge 74.

As discussed in greater detail below, alternative secondary housing sections may also be attached to the base unit of modular device 20. In the embodiment illustrated in FIGS. 1 and 2, the base unit 21 of modular device 20 includes all of the structures shown in FIGS. 1 and 2 except for the secondary housing section 52 and fasteners 54.

Figure 3:
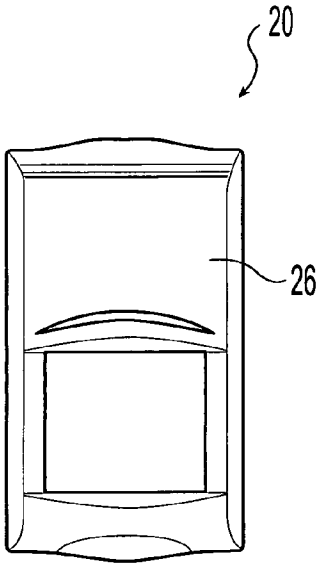
FIG. 3 is a front view of the modular intrusion detection unit of FIG. 1.
Figure 9:
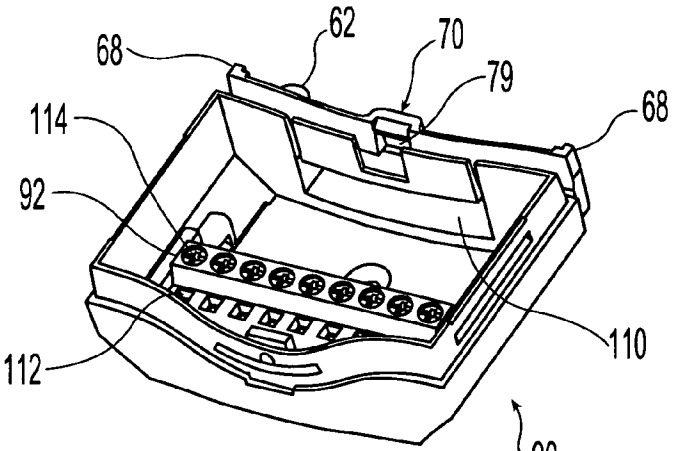
FIG. 9 is a perspective view of the housing section used with the camera module of FIG. 5.
Figure 10:
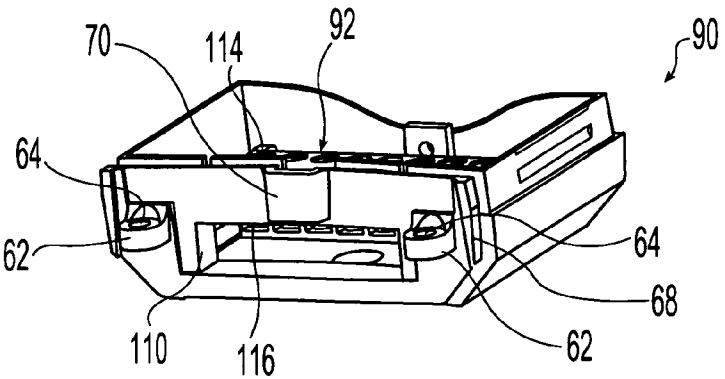
FIG. 10 is another perspective view of the housing section of FIG. 9.

After attachment of secondary housing section 52 to base housing section 24, removable cover 26 can be mounted on device 20. To facilitate the mounting of removable cover 26, secondary housing section 52 includes an attachment feature 70 and removable cover 26 includes an attachment feature 72. Engagement of mounting interfaces 56 and 57 and attachment of secondary housing section 52 to base housing section 24 properly positions attachment feature 70 to engage with attachment feature 72 on cover 26. Cover 26 also includes a projection 74 located the end of cover 26 opposite attachment feature 72. To attach cover 26, projection 74 is positioned in recess 76 located on base housing section 24. Cover 26 is then pivoted to engage first attachment feature 72 on cover 26 with the second attachment feature 70 on secondary housing section 52. The attachment feature 72 on cover 26 includes a wedge shaped projection 78 which snap fits into a recess (see recess 79 in FIG. 9) on feature 70 and a locking member 80. Locking member 80 includes an asymmetrically positioned locking structure 82 and a head 84. The locking member 80 is positioned in bore 86. A flat head screwdriver or similar tool is used to turn head 84 and thereby securely engage locking structure 82 with latching feature 70 which is thereby firmly secured between locking structure 82 and projection 78 and prevents the withdrawal of projection 78 from its receiving recess. A cover member 88 is used to cover locking member 80 after installation. FIG. 3 illustrates an assembled modular device 20.

Figure 4:
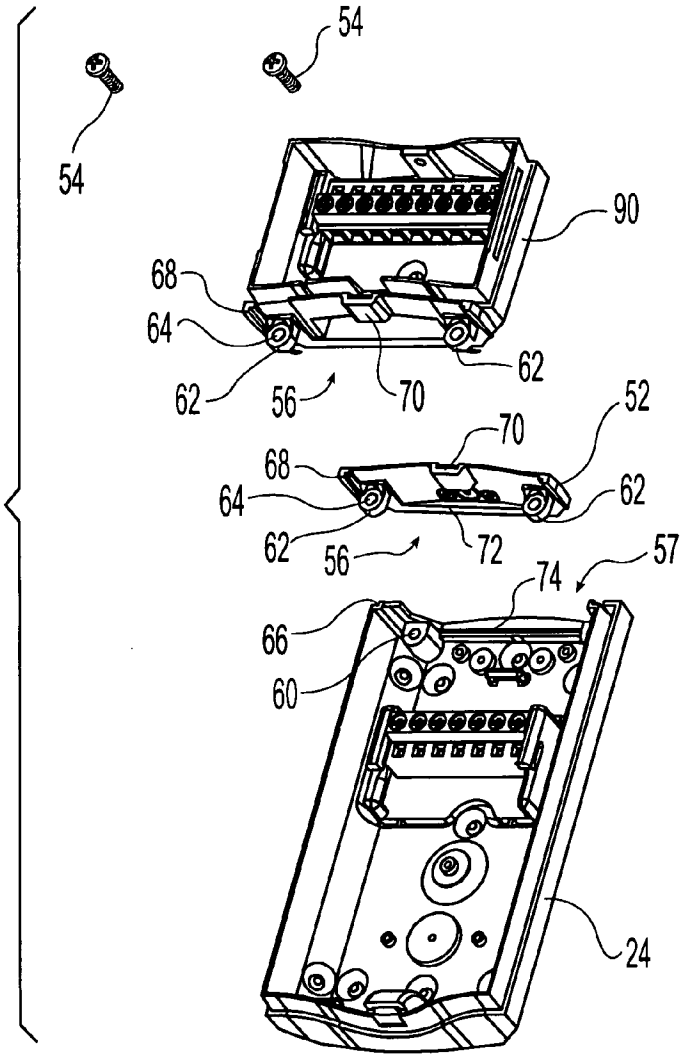
FIG. 4 is an exploded view of the base housing section of the unit of FIG. 1 and two additional housing sections that can be alternatively attached to the base housing section.
Figure 6:
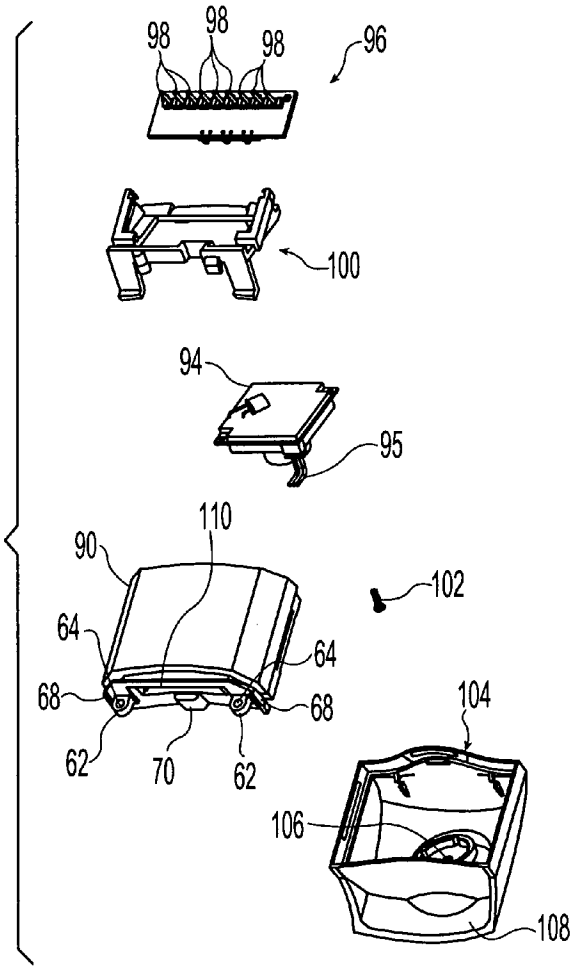
FIG. 6 is another exploded view of the camera module of FIG. 5.
Figure 5:
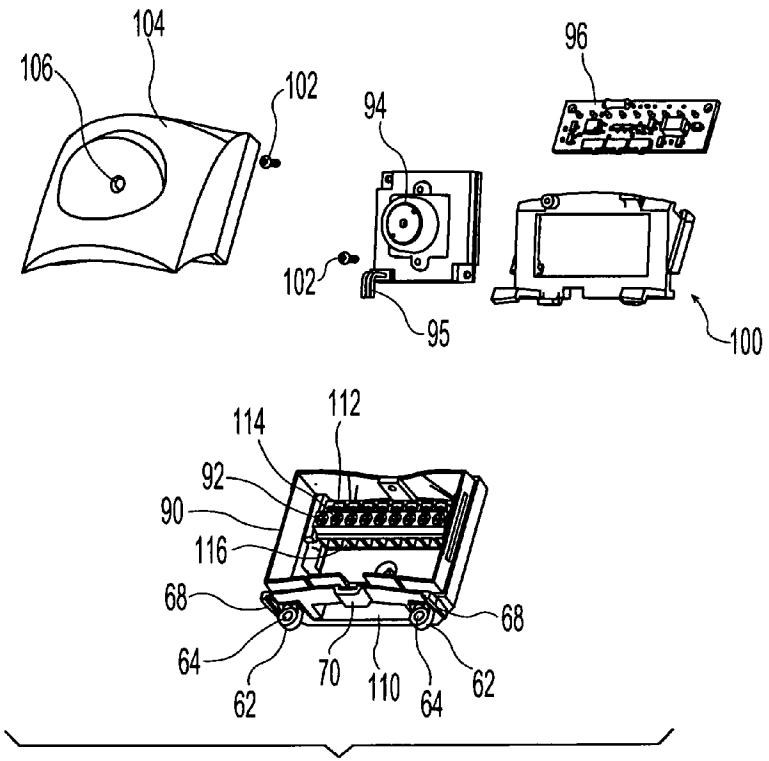
FIG. 5 is an exploded view of a camera module.

As shown in FIG. 4, instead of attaching a secondary housing section 52 which merely completes the housing structure of base unit 21, an alternative secondary housing section 90 having an associated secondary device, e.g., a charge coupled device (CCD) camera 94, may be attached to base housing section 24. As best seen in FIGS. 5 and 6, housing section 90 is part of the housing of a camera module. A terminal strip 92 is provided in housing section 90. For both primary terminal strip 28 and secondary terminal strip 92, each strip has a conventional construction and contains a plurality of terminals 112 with an associated fastener 114 and wire port 116. Each of the terminals 112 are adapted to receive a conductive pin and establish electrical contact with a pin that is inserted into the terminal. Fasteners 114 are used to securely hold a wire inserted into a wire port 116 whereby the secured wire is in electrical communication with the conductive pin inserted into the associated terminal 112 as known to those having ordinary skill in the art.

In the illustrated embodiments, the plurality of terminals 112 defined by strips 28, 92 are each adapted to receive one of the plurality of conductive elements 34 or 98 which take the form of elongate conductive pins. Alternative embodiments, however, may employ different types of conductive elements on the primary and secondary devices to establish electrical contact with a plurality of terminals located on the primary and secondary housings.

The camera module of FIGS. 5 and 6 includes a printed circuit board (PCB) 96 which is connected to CCD 94 via wires 95. PCB 96 and CCD 94 are mounted on a polymeric holder 100 with fasteners 102. PCB 96 also includes a plurality of conductive pins 98 which are each inserted into a respective one of terminals 112 when holder 100 is mounted within housing section 90. After securing housing section 90 to base housing section 24, wires are passed through wireway opening 110 to connect terminal strips 28 and 92 and to connect modular device 20*a* to a security system. The interconnection of terminal strips 28 and 92 is discussed with reference to FIG. 11 and in greater detail below. The operation of a camera device which includes a CCD and an associated PCB is well known to those having ordinary skill in the art.

Figure 8:
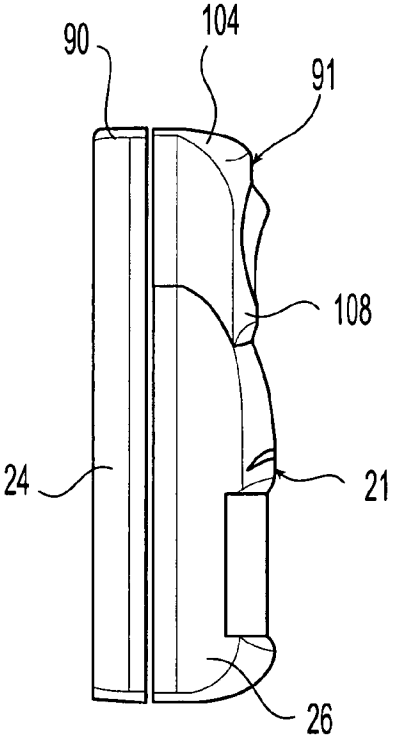
FIG. 8 is a side view of the intrusion detection unit of FIG. 1 with the camera module of FIG. 5 attached thereto.
Figure 7:
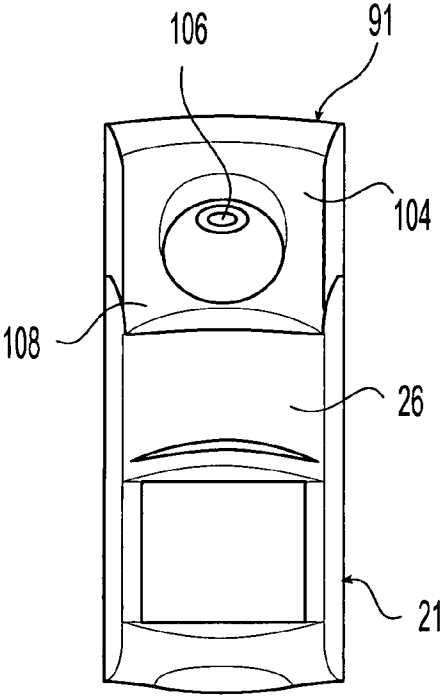
FIG. 7 is a front view of the intrusion detection unit of FIG. 1 with the camera module of FIG. 5 attached thereto.

FIGS. 7 and 8 illustrate the camera module of FIGS. 5 and 6 mounted on base unit 21 of FIGS. 1 and 2. After connecting terminal strips 28 and 92 and mounting device 20*a* on a wall or other location, outer cover 104 can be installed. As can be seen in FIGS. 5–8, outer cover 104 includes a camera opening 106 for CCD 94 and a shroud 108. Shroud 108 extends partially over the exterior surface of removable cover 26 and is used to provide a more aesthetic junction between outer covers 104 and 26.

Figure 11:
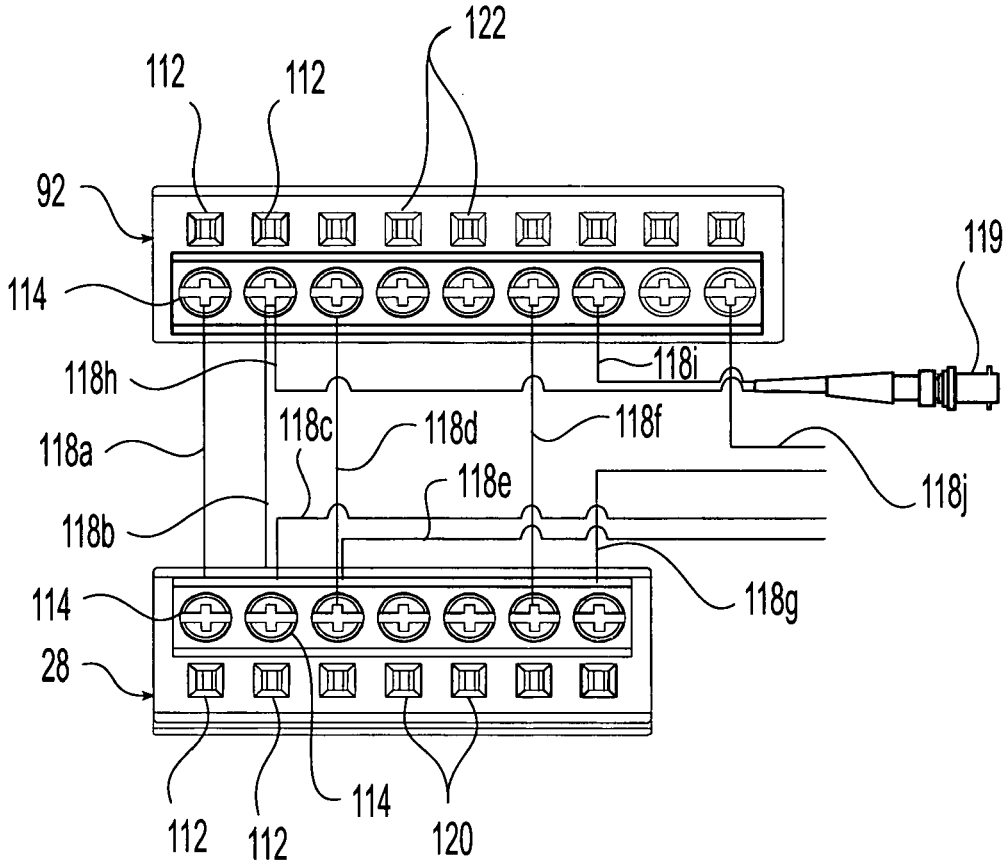
FIG. 11 is a wiring diagram illustrating the interconnection between the intrusion detection unit of FIG. 1 and the camera module of FIG. 5.

FIG. 11 is a wiring diagram showing terminal strips 92 and 28 and illustrating how camera module 91 is connected with base unit 21 and with a security system. Lines 118*b* and 118*d* provide electrical power and ground camera module 91 while lines 118*c* and 118*e* provide electrical power and ground base unit 21. More specifically, lines 118*b* and 118*c* are ground lines and lines 118*d* and 118*e* are DC electrical power lines. Line 118*f* is a digital alarm line and when base unit 21 detects an intruder an alarm signal is transmitted to camera module 91 from base unit 21 via line 118*f*. Camera module 91 may be set to be constantly acquiring images with CCD 94 or it may only activate CCD 94 upon receipt of an alarm signal. For example camera module may be set to transmit images from CCD 94 for 15 or 90 seconds following the receipt of an alarm signal from base unit 21. Thus, secondary device 94, 96 is responsive to the alarm signal generated by the primary device 30 of base unit 21.

Lines 118*h* and 118*i* are BNC cable lines connecting BNC plug 119 to camera module terminal strip 92. BNC plug 119 provides a connection between camera module 91 and the security system whereby the video images acquired by CCD 94 can be viewed on a monitor at a remote location. Terminals 120 on strip 28 are in communication with alarm relays and are used to communicate an alarm signal to the security system in a manner well known to those having ordinary skill in the art. Terminals 122 on strip 92 can be used to connect camera module 91 to a video recorder. Lines 118*a*, 118*g*, and 118*j* are tamper detection lines. Lines 118*a*, 118*g*, and 118*j*, together with PCBs 32 and 96 define a closed circuit and if either PCB 32 or 96 is disconnected from their respective terminal strip 28, 92, the tamper circuit defined in part by lines 118*a*, 118*g* and 118*j* will be opened. Because lines 118*g* and 118*j* are connected to the security system, the opening of the tamper detection circuit by the disconnection of either PCB 32 or 96 can be detected at a remote location.

FIGS. 12 and 13 illustrate another functional module, i.e., microphone module 124, that can be used with base unit 21. As seen in FIG. 12, microphone module 124 includes a housing section 126, a microphone 128 and an outer cover 130. Housing section 126 includes a terminal strip 132 that connect with conductive pins 136 on microphone assembly 128. Wires 138 (only one is shown) extend through wireway 110 to connect terminal strip 132 with terminal strip 128 and the security system. Cover 130 includes one or more openings 131 to allow microphone assembly 128 to monitor the surrounding environment. As best seen in FIG. 12, housing section 126 includes a mounting interface 56 that is similar to the mounting interface of housing sections 52 and 90. FIG. 13 illustrates microphone module 124 mounted to base unit 21. A line between terminal strips 28 and 132 can be used to communicate an alarm signal to microphone module 124 similar to the digital alarm line used with camera module 91 to thereby activate microphone module 124 for a predetermined period of time when base unit 21 detects the presence of an intruder. The noises detected by microphone 128 can then be communicated to the security system where they may be monitored at a remote location. Although in the illustrated embodiment a terminal strip 132 is used to provide communication with microphone 128, in alternative embodiments, wires may be used to directly couple microphone 128 with terminal strip 28 and the security system.

Figure 14:
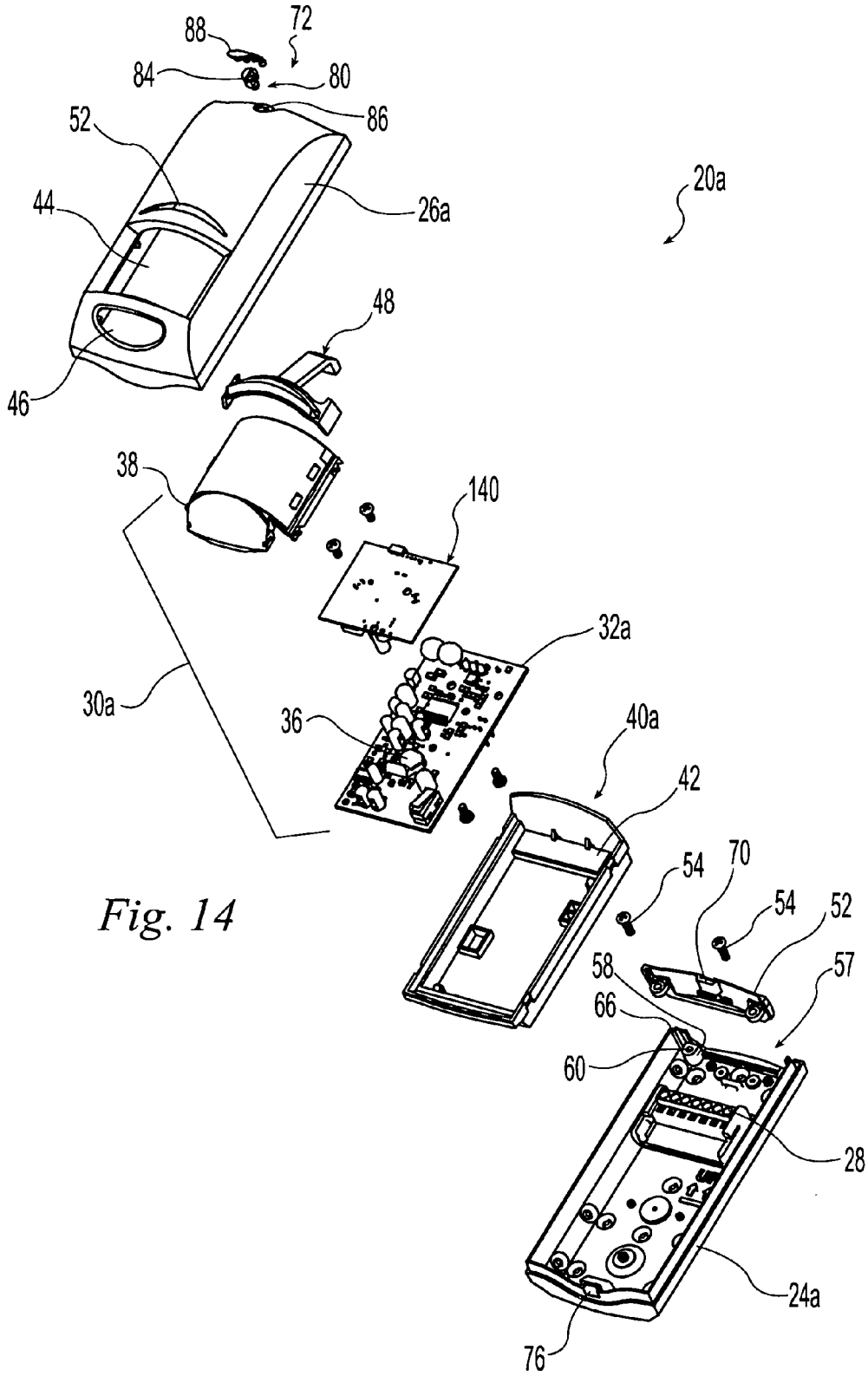
FIG. 14 is an exploded view of a second intrusion detection unit.
Figure 15:
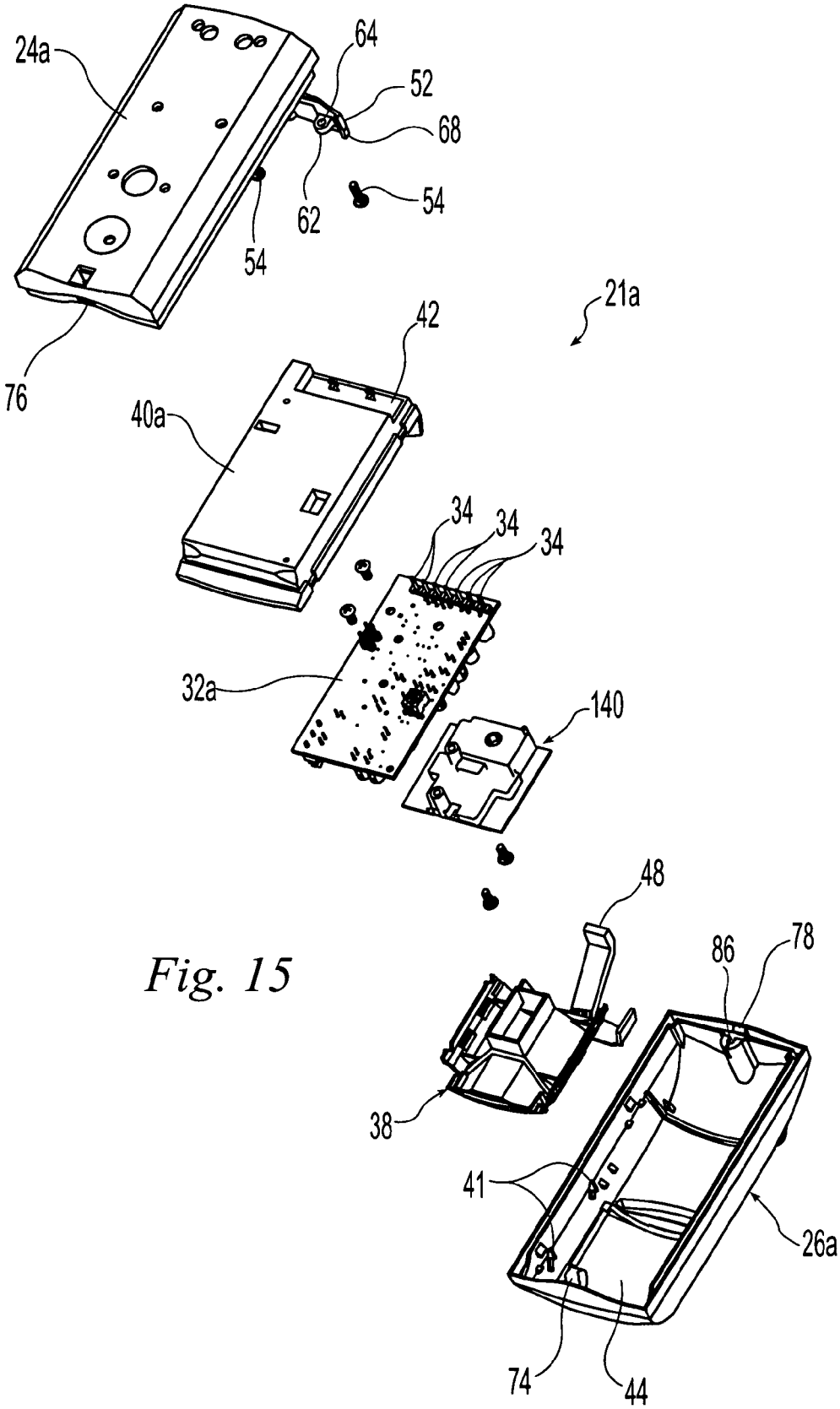
FIG. 15 is another exploded view of the intrusion detection unit of FIG. 14.

FIGS. 14 and 15 illustrate a base unit having an alternative intrusion detection device. Base unit 21*a* includes all of the parts illustrated in FIG. 15 except for secondary housing section 52 and fasteners 54, which together with base unit 21*a* form one option of modular device 20*a*. In the modular device 20*a* illustrated in FIGS. 14 and 15, the intrusion detection device, i.e., the primary device, 30*a* includes not only a PIR sensor 36 but also includes a microwave assembly 140 which utilizes microwave radar to detect the presence of an intruder. Such dual technology intrusion detection devices are well known to those having ordinary skill in the art. Those items used in unit 20*a* that are similar to those described above with reference to unit 20 are given the same reference numeral as used in unit 20 and a description of all such features has not been repeated. Those features found in unit 20*a* which differ from corresponding features found in unit 20 have been given a similar reference numeral as used with unit 20 together with a suffix "a". Thus, PCB 32*a* is generally similar to PCB 32 but has been modified to adapt it for use with microwave assembly 140. Similarly, cover 40*a* is similar to cover 40 but has been altered to account for the differing dimensions of PCB 32*a*. Base housing section 24*a* and removable outer cover 26*a* are also similar to base housing section 24 and removable cover 26 but are slightly elongated to account for the larger dimensions of device 30*a* with respect to device 30.

Base housing section 24*a*, includes a mounting interface 57 that includes two mounting posts 58, threaded openings 60 and corner recesses 66 to enable the mounting interfaces 56 of housing sections 52, 90 and 126 to be directly attached thereto. By providing a mounting interface 56 on each of the secondary housing sections, i.e., housing sections 52, 90 and 126, that can be attached to the mounting interface 57 of any of the primary devices, i.e., base units 21 and 21*a*, a wide variety of different products may be assembled from a relatively limited number of individual modules. For example, with the two base units 21 and 21*a* and three separate secondary housing sections 52, 90 and 126 (and associated secondary devices), six different modular devices can be assembled. Of course, increasing the number of base units and modules attachable thereto will greatly increase the total number of possible combinations. Examples of various intrusion detection devices that can be used with the present invention are described in U.S. Pat. Nos. 5,450,062; 5,382,944; 5,077,548; and 4,864,136 which are hereby incorporated herein by reference.

This modularity also provides flexibility in the installation and upgrading of a security system. For example, a building owner desiring to install a security system can purchase identical base units for installation and then modify individual units based upon their location by selectively installing camera or microphone modules on the base units, or, if no such functional module is desired, a secondary housing section, e.g., section 52, that does not have a secondary device associated therewith. Moreover, it is possible to later upgrade the camera or other functional module used with the base unit without having to replace the base unit. It is also possible to later upgrade a base unit that had a housing section 52 installed to include a functional module without having to replace the base unit.

Figure 16:
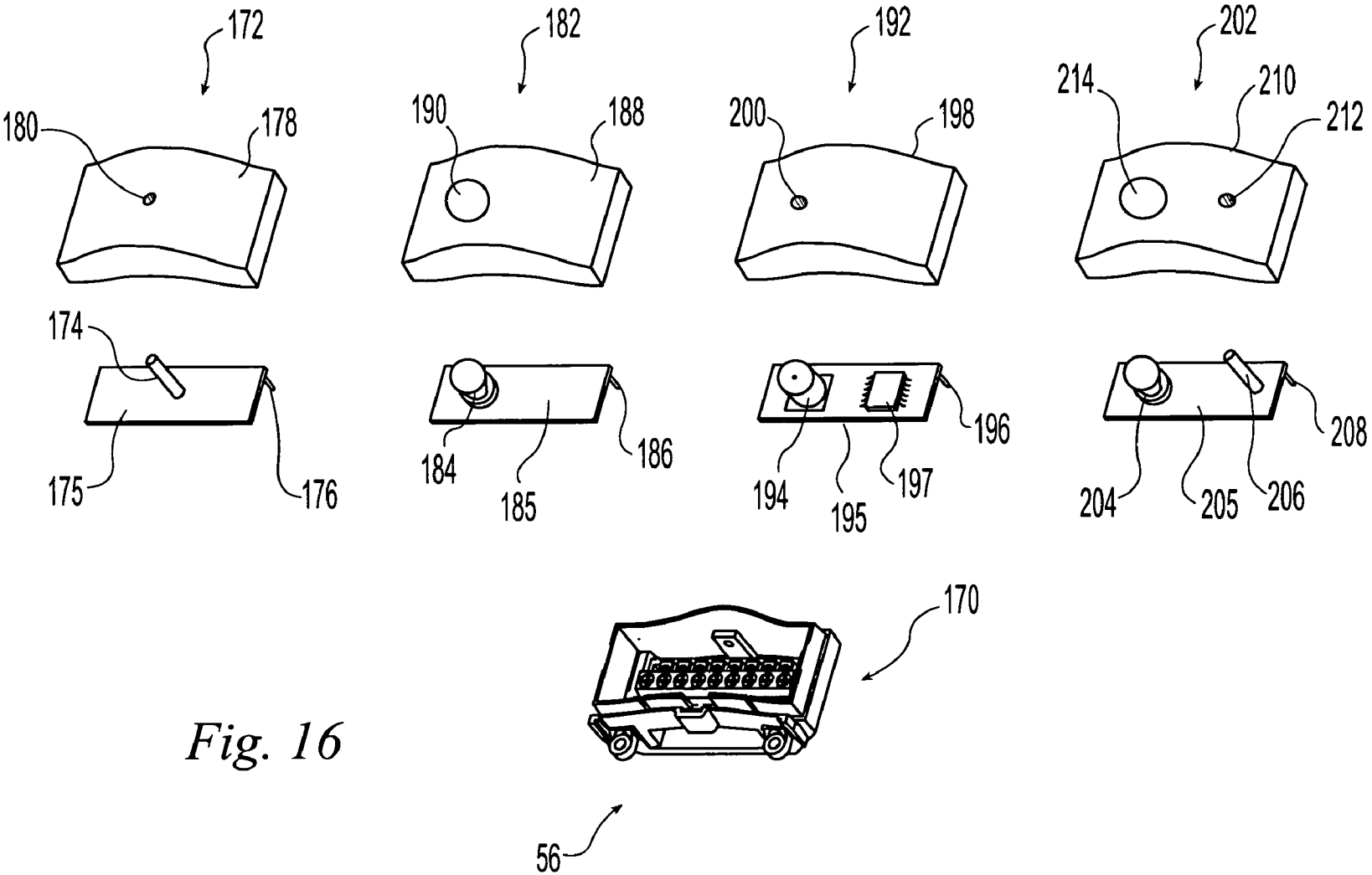
FIG. 16 is an exploded view showing various alternative modules.
Figure 17:
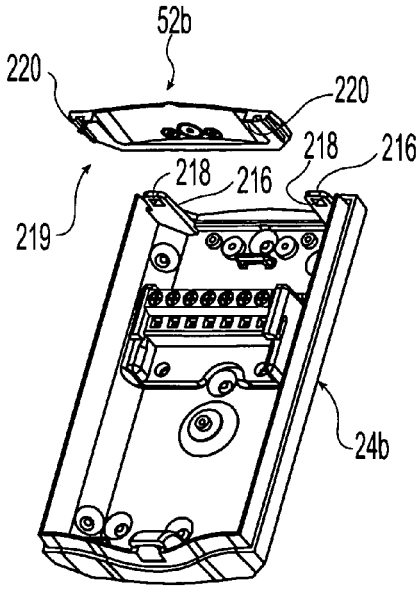
FIG. 17 is an exploded view of a base housing section and a secondary housing section having a snap-fit connection.
Figure 18:
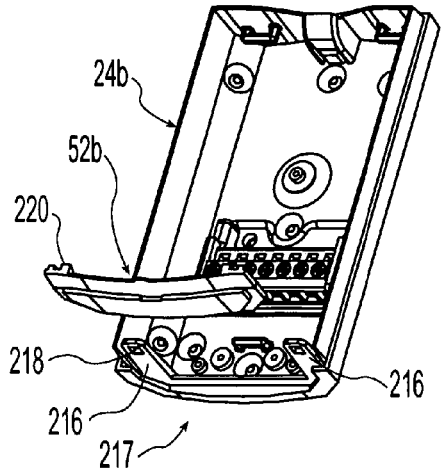
FIG. 18 is another exploded view of the housing sections of FIG. 17.
Figure 19:
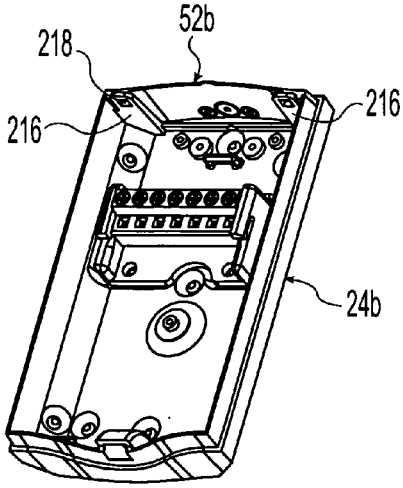
FIG. 19 is a perspective view of the housing sections of FIG. 17 attached together.
Figure 20:
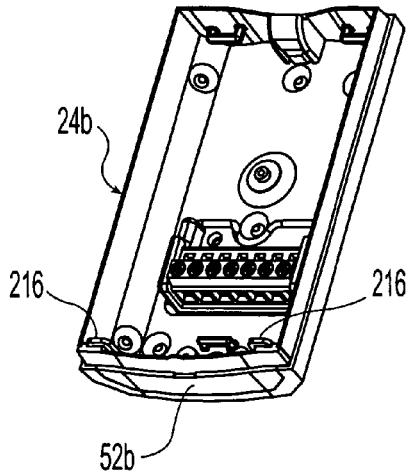
FIG. 20 is another perspective view of the housing sections of FIG. 17 attached together.

A large number and variety secondary modules can be used with the base units. FIG. 16 schematically depicts examples of several such modules. Each of the individual modules has a base housing section with a mounting interface 56 that allows them to be attached to either base unit 21 or base unit 21*a*. Only one base housing section 170 is shown in FIG. 16 and has a size that allows it to be used with any of the depicted secondary devices. Also shown in FIG. 16 is a lighting module assembly 172 which includes a printed circuit board 175 having a light emitting diode 174 and conductive elements, i.e., conductive pins 176, for insertion in the terminal strip of base housing section 170. Outer cover 178 includes an opening 180 through which LED 174 projects. LED 174 may be used to illuminate the area surrounding the detector and thereby provide an emergency light. A loudspeaker module assembly 182 that can be used with housing section 170 is also depicted in FIG. 16. This assembly also includes a printed circuit board 185 on which a speaker 184 or other noise generating device is mounted. PCB 185 also includes conductive pins 186 for engagement with the terminal strip in housing section 170. Outer cover 188 includes an opening 190 that may include a fabric cover or other noise permeable membrane. Speaker 184 may be used, for example, to generate an audible warning, either a tone or voice alert, upon receipt of an alarm signal, as well as for other suitable purposes.

A camera module assembly 192 is also shown. Assembly 192 includes a printed circuit board 195 having a CCD 194 for acquiring images through opening 200 in outer cover 198 and conductive pins 196 for engagement with the terminal strip of housing section 170. PCB 195 also includes a flash memory 197 for storing images acquired by CCD 194. The image data stored in flash memory 197 may be communicated to another device in various ways. For example, the data may be communicated via a wired connection with a building security network installed at installation, or, assembly 192 may include a USB port for connecting with a portable computer or local area network whereby the data may be downloaded. Assembly 192 may also provide wireless communication for downloading the image data using conventional wireless communication technology such as bluetooth. Other suitable means for communicating the data stored in flash memory 197 may also be employed. The various secondary devices may also be combined together in various combinations. For example, secondary device assembly 202 includes both a speaker 204 and an LED 206 mounted on printed circuit board 205. Conductive pins 208 are engaged with the terminal strip of housing section 170. Outer cover 210 includes an opening 212 for LED 206 and a second opening 214 having a fabric or other noise permeable membrane.

Although one set of cooperating mounting interfaces employing fasteners 54 has been illustrated, other mounting interfaces for use with base units 21 and 21*a* and the various secondary modules may also be employed. For example, FIGS. 16–19 illustrate an alternative set of mounting interfaces which employ a snap-fit connection. In this embodiment, base housing section 24*b* has flexible posts 216 with openings 218 at mounting interface 217. Secondary housing section 52*b* has a mounting interface 219 with wedge shaped projections 220 which snap fit into openings 218 to thereby secure housing section 52*b* to housing section 24*b*. Other forms of mounting interfaces may also be employed.

Figure 21:
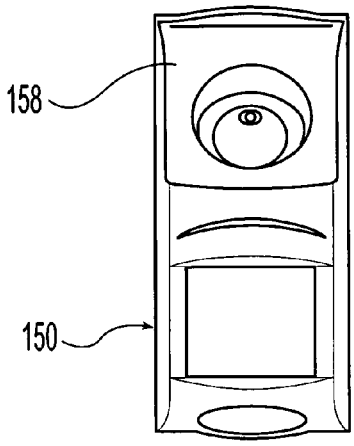
FIG. 21 is a front view of a third intrusion detection unit having a camera module mounted thereon.
Figure 22:
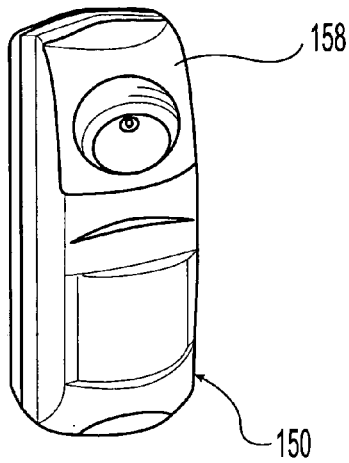
FIG. 22 is a perspective view of the intrusion detection unit of FIG. 21.
Figure 23:
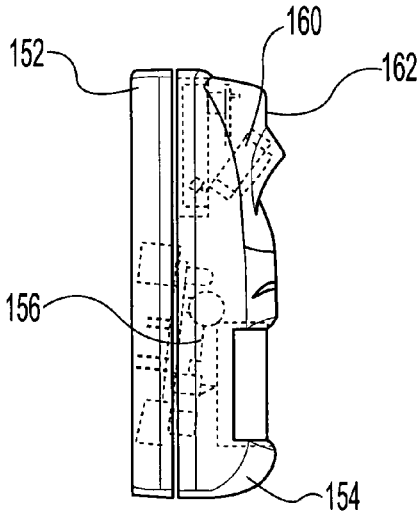
FIG. 23 is a side view of the intrusion detection unit of FIG. 21.
Figure 24:
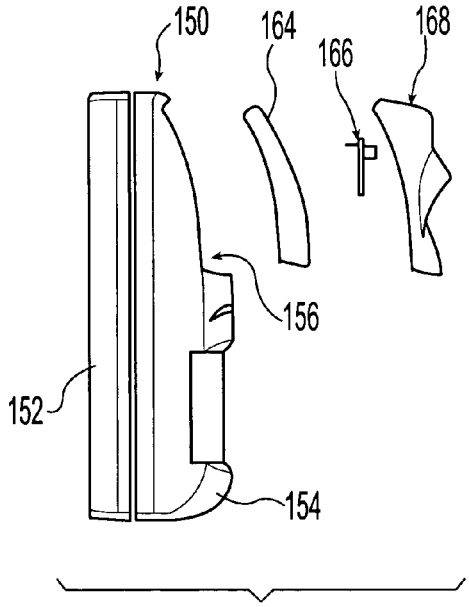
FIG. 24 is an exploded side view of the intrusion detection unit of FIG. 21 with alternative modules.

A different modular system is illustrated in FIGS. 21–24. In this system, a base unit 150 has a base housing section 152 and a removable cover 154. An intrusion detection device 156 is mounted between housing section 152 and cover 154. Removable cover 154 includes a port 156 in which interchangeable housing sections may be mounted. In FIGS. 21–23, a camera module 158 having a CCD 160 and an associated housing section 162 are mounted in port 156. FIG. 24 illustrates alternative modules that can be mounted in port 156. A housing section 164 without any associated device is shown in FIG. 24 and can be used if no secondary functions are desired. Also shown in FIG. 24 is an exploded view of a microphone module having a microphone 166 and an associated housing section 168 that together can be mounted in port 156. A selected housing section may be mounted in port 156 by a snap-fit engagement, adhesives, or other suitable attachment means.

While this invention has been described as having an exemplary design, the present invention may be further modified within the spirit and scope of this disclosure. This application is therefore intended to cover any variations, uses, or adaptations of the invention using its general principles.

What is claimed is:

1. A modular intrusion detection system, said modular system comprising:

a base unit including a primary intrusion detection system component disposed within a primary housing, said primary housing defining a first mounting interface; and a plurality of intrusion detection modules, each said module including a secondary intrusion detection system component and a secondary housing section, each said module having a unique capability, each of said secondary housing sections having a second mounting interface, each of said second mounting interfaces being engageably securable to said first mounting interface to thereby securably attach a selected one of said modules to said primary housing, whereby said base unit and a selected one of said plurality of modules may be selectively assembled into an operative detection system having selected capabilities.

2. The modular system of claim 1 wherein said primary housing includes a base housing section and a removable cover, said base housing section defining said first mounting interface, said removable cover comprising a first attachment feature; each of said secondary housing sections including a second attachment feature engageable with said first attachment feature wherein attachment of said removable cover to said base housing section engages said first attachment feature with said second attachment feature of the selected one of said secondary housing sections to secure said primary housing to one of said modules.

3. The modular system of claim 1 wherein one of said first and second mounting interfaces include at least one threaded opening for receiving a threaded fastener, said threaded fastener securing said secondary housing section to said primary housing.

4. The modular system of claim 1 wherein said first and second mounting interfaces are securable together with a snap-fit engagement.

5. The modular system of claim 1 wherein said primary intrusion detection system component generates an alarm signal and said at least one secondary intrusion detection module is couplable to said primary intrusion detection system component and wherein said secondary intrusion detection module is responsive to said alarm signal.

6. The modular system of claim 1 wherein said primary housing includes a primary terminal strip, said primary terminal strip being connectable to a security system and having a plurality of primary terminals, said primary intrusion detection system component including a plurality of conductive elements, each of said primary conductive elements being operably couplable with one of said plurality of primary terminals and wherein said at least one secondary intrusion detection module including a secondary terminal strip, said secondary terminal strip being connectable to said primary terminal strip and having a plurality of secondary terminals, said secondary intrusion detection module including a plurality of secondary conductive elements, each of said secondary conductive elements being operably couplable with one of said plurality of secondary terminals.

7. The modular system of claim 6 wherein said at least one secondary housing section defines an opening for passing wires from said primary terminal strip to said secondary terminal strip.

8. The modular system of claim 1 wherein one of said secondary intrusion detection system components comprises an image capturing device.

9. The modular system of claim 1 wherein one of said secondary intrusion detection system components comprises a microphone.

10. The modular system of claim 1 wherein one of said secondary intrusion detection system components comprises a light source.

11. The modular system of claim 1 wherein one of said secondary intrusion detection system components comprises a speaker.

12. A modular intrusion detection system, said modular system comprising:

a base unit including a primary device disposed within a primary housing wherein said primary device is an intrusion detection component, said primary device generating an alarm signal upon detection of an intruder; and a plurality of intrusion detection modules, each said module including a secondary intrusion detection system component comprising one of an image capturing device, a microphone, a camera, a speaker, a light source, a microwave transceiver, and a passive infrared sensor, each said modules including a secondary housing section, each said secondary housing sections being selectively directly attachable to said primary housing, at least one of said secondary components responsive to said alarm signal generated by said primary device when said secondary module is coupled to said primary device.

13. The modular system of claim 12 wherein at least one of said secondary devices comprises an image capturing device.

14. The modular system of claim 12 wherein at least one of said secondary devices comprises a microphone.

15. The modular system of claim 12 wherein said primary housing defines a first mounting interface and each of said secondary housing sections defines a second mounting interface, each of said second mounting interfaces being engageably securable to said first mounting interface to thereby securably attach a selected one of said secondary housing sections to said primary housing.

16. The modular system of claim 15 wherein said primary housing includes a base housing section and a removable cover, said base housing section defining said first mounting interface, said removable cover comprising a first attachment feature; each of said secondary housing sections including a second attachment feature engageable with said first attachment feature, wherein attachment of said cover to said base housing section engages said first attachment feature with said second attachment feature of the selected one of said secondary housing sections which is securably attached to said primary housing section.

17. The modular system of claim 12 wherein said primary housing includes a primary terminal strip, said primary terminal strip being connectable to a security system and having a plurality of primary terminals, said primary device including a plurality of conductive elements, each of said primary conductive elements being operably couplable with one of said plurality of primary terminals and wherein each of said secondary housing sections includes a secondary terminal strip, said secondary terminal strips being connectable to said primary terminal strip and having a plurality of secondary terminals, said secondary system components each including plurality of secondary conductive elements, each of said secondary conductive elements being operably couplable with one of said plurality of secondary terminals.

18. A modular intrusion detection system connectable to a security system, said modular system comprising:

a base unit including a primary device disposed within a primary housing, said primary device comprising an intrusion detection device, said primary housing including a primary terminal strip, said primary terminal strip being connectable to a security system and having a plurality of primary terminals, said primary device including a plurality of primary conductive elements, each of said primary conductive elements being operably couplable with one of said plurality of primary terminals;

a plurality of secondary intrusion detection modules, each said secondary module including a secondary intrusion detection system component comprising one of an image capturing device, a microphone, a camera, a speaker, a light source, a microwave transceiver, and a passive infrared sensor, each said secondary modules being operably couplable to said primary device, each said secondary modules having a secondary housing section associated therewith, each said secondary housing sections being directly attachable to said primary housing section and having a secondary terminal strip, each of said secondary terminal strips being connectable to said primary terminal strip and having a plurality of secondary terminals, each of said secondary modules including a plurality of secondary conductive elements, each of said secondary conductive elements being operably couplable with one of said plurality of secondary terminals; and wherein a modular device is assembled by selecting one of said plurality of secondary modules, attaching said associated secondary housing section of said selected one of said secondary modules to said primary housing and coupling said selected one of said secondary modules to said primary device.

19. The modular system of claim 18 wherein at least one of said secondary modules comprises an image capturing device.

20. The modular system of claim 18 wherein at least one of said secondary modules comprises a microphone.

21. The modular system of claim 18 wherein one of said secondary modules comprises a light source.

22. The modular system of claim 18 wherein one of said secondary modules comprises a speaker.

23. The modular system of claim 18 wherein said primary device generates an alarm signal, said alarm signal being communicated to the security system and said selected secondary module, said secondary module being responsive to said alarm signal.

24. The modular system of claim 18 wherein said primary housing defines a first mounting interface and each of said secondary housing sections defines a second mounting interface, each of said second mounting interfaces being engageably securable to said first mounting interface to thereby securably attach a selected one of said secondary housing sections to said primary housing section.

25. The modular system of claim 24 wherein said primary housing includes a base housing section and a removable cover, said base housing section defining said first mounting interface, said removable cover comprising a first attachment feature; each of said secondary housing sections including a second attachment feature engageable with said first attachment feature wherein attachment of said cover to said base housing section engages said first attachment feature with said second attachment feature of the selected one of said secondary housing sections securably attached to said primary housing section.

* * * * *